US005975517A

United States Patent [19]

Lim

[11] Patent Number: 5,975,517

[45] Date of Patent: Nov. 2, 1999

[54] PAPER FEEDING APPARATUS OF PRINTING DEVICE

[75] Inventor: Kwang-taek Lim, Kwangmyung, Rep. of Korea

[73] Assignee: Samsung Electronics Co., Ltd., Kyungki-do, Rep. of Korea

[21] Appl. No.: 09/081,136

[22] Filed: May 19, 1998

[30] Foreign Application Priority Data

Jul. 9, 1997 [KR] Rep. of Korea ..... 97-31726

[51] Int. Cl.[6] ..... B65H 3/06

[52] U.S. Cl. ..... 271/117; 271/162; 271/171

[58] Field of Search ..... 271/117, 113, 271/171, 162, 164

[56] References Cited

U.S. PATENT DOCUMENTS 4,780,740 10/1988 Fukae ..... 271/171 X 5,060,927 10/1991 Sugiura ..... 271/117

5,106,072 4/1992 Sugiura et al. ..... 271/117

5,215,303 6/1993 Yamada et al. ..... 271/171 X

*Primary Examiner*—David H. Bollinger

*Attorney, Agent, or Firm*—Sughrue, Mion, Zinn, Macpeak & Seas, PLLC

[57] ABSTRACT

A paper feeding apparatus, of a printing machine which includes a cassette for receiving paper that is detachably coupled with a body of the printing device, guide members for supporting side portions of the received paper, slidingly installed in the cassette, and a pair of pick-up rollers for drawing the paper out from the cassette. The pick-up rollers are positioned for tight contact with the top of the received papers and are movably installed on a rotating shaft so as to be capable of moving along the shaft. The paper feeding apparatus also includes a moving mechanism, interlocking with the guide member, for moving the pick-up roller along the shaft.

8 Claims, 4 Drawing Sheets

PAPER FEEDING APPARATUS OF PRINTING DEVICE

BACKGROUND OF THE INVENTION

1. Field of the Invention

The present invention relates to a paper feeding apparatus of a printing device, and more particularly, to a paper feeding apparatus having an improved structure for supplying paper from a cassette to the inside of the printing device.

2. Description of the Related Art

In a typical printing device such as a printer or a copying machine, a paper feeding apparatus receives a multitude of paper sheets and supplies that paper into the body of the printing device in sequence.

As shown in FIG. 1, a conventional paper feeding apparatus includes a cassette 20 capable of moving along guide rails 11 and 12 provided in the body 10 of the printing device and for receiving papers therein. The feeding apparatus also includes a pickup roller 13, rotatably installed in the body 10, for drawing out the paper received in the cassette 20.

The cassette 20 includes side guide members 21 and 22 and a rear guide member 23 slidably installed, for supporting both sides and the rear end portion of the received paper, respectively. The cassette also includes finger members 25 and 26 for pressing and supporting corner portions of a fore end of the received paper, extended from the side guide members 21 and 22, and a receiving plate 24 for receiving paper and lifting the fore end portion of the received paper toward the finger members 25 and 26.

Reference numeral 13*a* denotes a rotation shaft of the pick-up roller 13, whereas arrow 'A' indicates the direction in which the cassette 20 is connected to the body 10 of the printing device, and arrow 'B' indicates the supply direction of the paper.

As shown in FIG. 2, the paper received in the cassette 20 is supplied by rotating the shaft 13a. The pick-up roller 13 rotates, and thus an uppermost paper 100 tightly contacting the pick-up roller 13 is fed in the direction indicated by arrow 'B'. At this time, the fore end corner portion of the paper 100 is caught by the finger members 25 and 26, so that the fore end portion of the paper is partially folded, which causes a curled portion 'C' indicated by dotted lines. When the pick-up roller 13 continues to rotate, the paper 100 is transferred in the direction indicated by arrow 'B', the fore end corner portion of the paper 100 slips out from the finger members 25 and 26 and is supplied to the inside of the body 10.

The curled portion 'C' facilitates drawing and supplying only the uppermost paper sheet from the cassette 20 to the inside of the body 10. That is, the curled portion suppresses the multitude of remaining supply sheets of paper at once. Thus, the curled portion must be appropriately formed in order to smoothly and repeatedly supply individual sheets of paper. A distance 'D' between the pick-up roller 13 and the finger members 25 and 26 is set considering the appropriate forming of the curled portion. That is, when the distance 'D' is too long or short, the curled portion is inappropriately formed, thus crumpling or tearing the paper.

However, by the above-described paper feeding apparatus, when the size of the received paper is changed, for example A4 to A3, the finger members 25 and 26 together with the side guide members 22 and 21 move to correspond to the size of the changed paper. However, the pick-up roller 13 is fixed in a predetermined position. Thus, the distance 'D' is changed, so that the curled portion may not be appropriately formed according to the change in the paper size.

SUMMARY OF THE INVENTION

To solve the above problem, it is an objective of the present invention to provide a paper feeding apparatus of a printing device capable of forming an appropriate curled portion by moving a pick-up roller according to the paper size.

Accordingly, to achieve the above objective, there is provided a paper feeding apparatus of the present invention including a cassette for receiving paper, detachably coupled with a body of the printing device; guide members, slidingly installed in the cassette, for supporting side portions of the received paper; a pair of pick-up rollers for drawing the paper out from the cassette, wherein the pick-up rollers are positioned for tight contact with the top of the received papers, and are movably installed on a rotating shaft so as to be capable of moving along the shaft; and moving means, interlocking with one of the guide members, for moving the pair of pick-up rollers along the shaft.

Also, the moving means includes a pinion rotatably installed in the body of the printing device; and a pair of rack members having geared portions which engage with the pinion such that the geared portions thereof face each other, and move in opposite directions to each other by interlocking with at least one of the guide members, thereby moving the pick-up rollers towards each other.

BRIEF DESCRIPTION OF THE DRAWINGS

The above and other objectives and advantages of the present invention will become more apparent by describing in detail a preferred embodiment thereof with reference to the attached drawings in which.

DESCRIPTION OF THE PREFERRED EMBODIMENT

Figure 1:
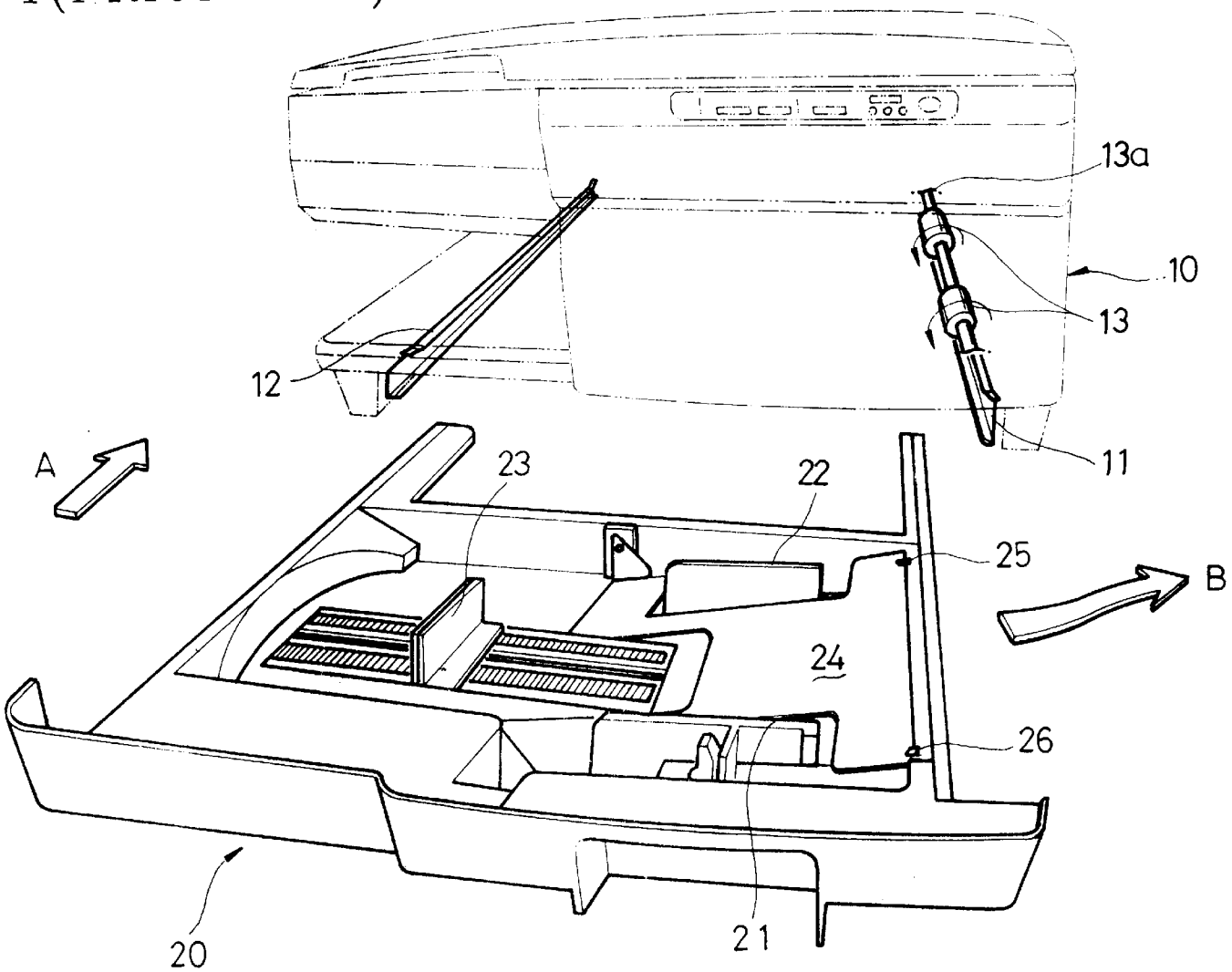
FIG. 1(PRIOR ART)
FIG. 1 is a perspective view of a conventional paper feeding apparatus of a printing device.
Figure 2:
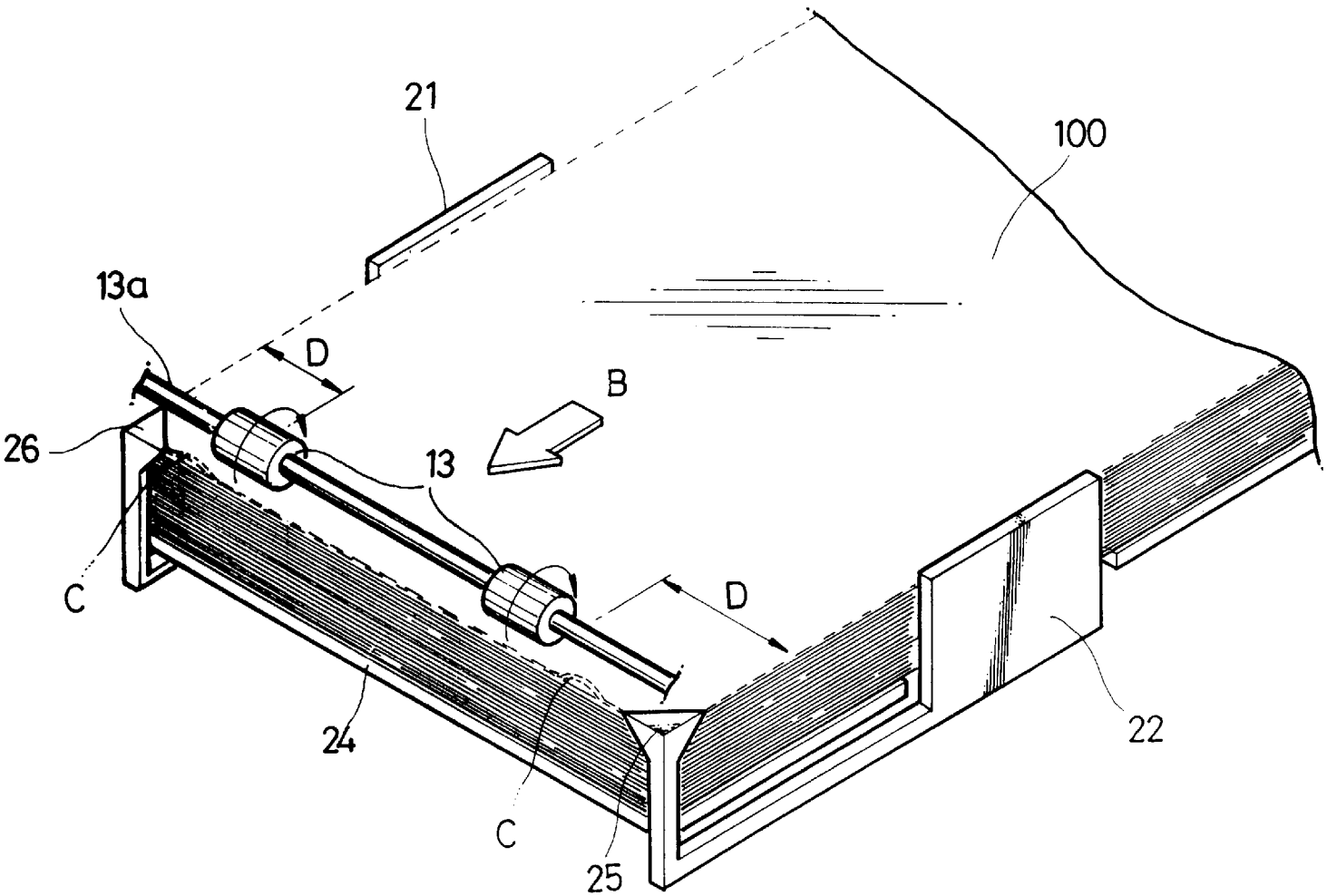
FIG. 2(PRIOR ART)
FIG. 2 is a perspective view partially showing the paper feeding apparatus of FIG. 1.
Figure 3:
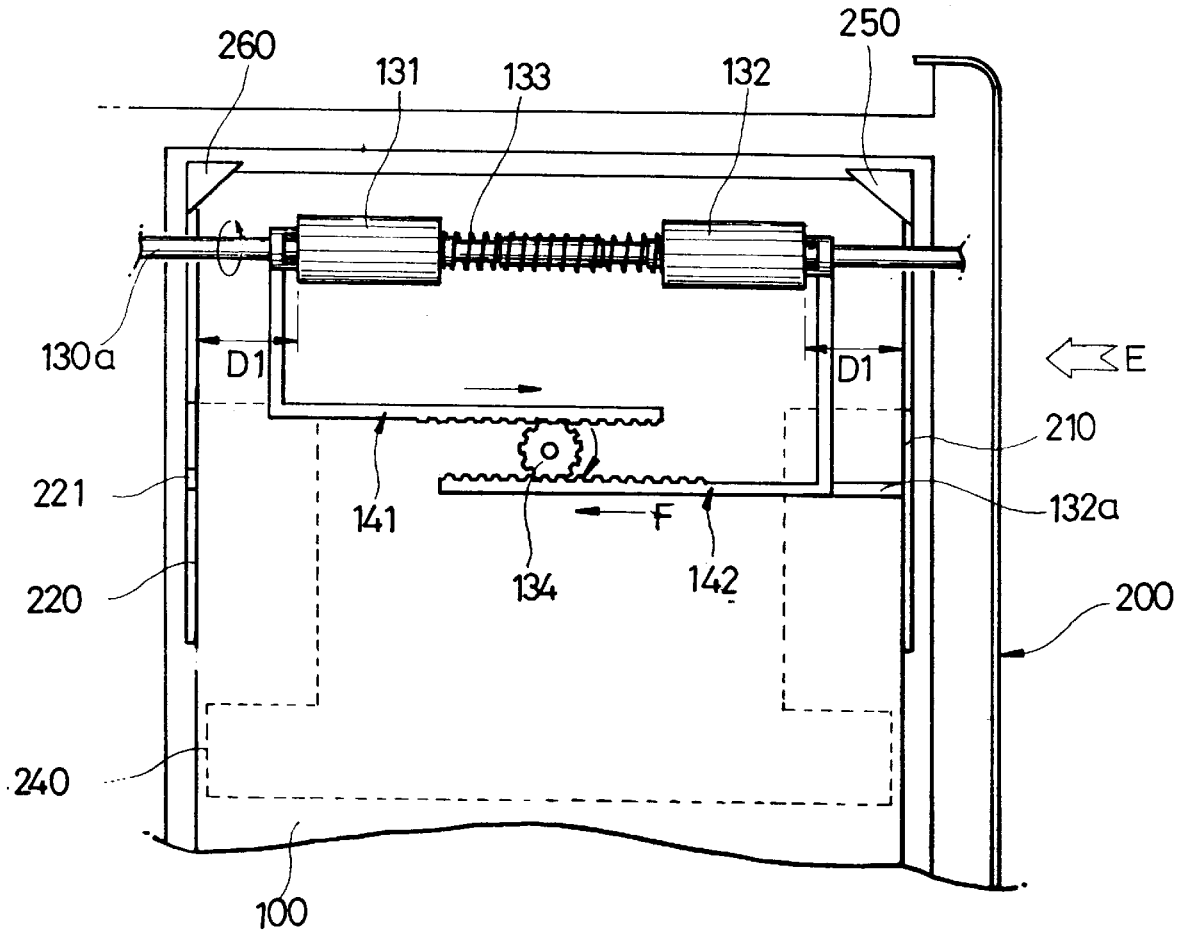
FIG. 3 is a plan view of a paper feeding apparatus according to the present invention.

Referring to FIG. 3, a paper feeding apparatus according to the present invention includes a cassette 200 for receiving paper 100, detachably coupled with a body (not shown) of a printing device, and first and second pick-up rollers 131 and 132, for transferring the paper 100 received in the cassette 200 to the inside of the body of the printing device according to the rotation of a shaft 130*a*, tightly in contact with the upper surface of the paper 100.

The cassette 200 includes first and second guide members 210 and 220 which support side portions of the received paper 100, and are slidingly installed therein. The cassette 200 also includes finger members 250 and 260 for pressing and supporting the fore end corner portion of the paper 100. The finger members 250 and 260 extend from the first and second guide members 210 and 220. Further, the cassette 200 includes a receiving plate 240 for lifting the paper 100 toward the finger members 250 and 260.

The first and second pick-up rollers 131 and 132 move along the shaft 130*a* by a moving means. The moving means includes a pinion 134 rotatably installed on the body of the printing device, first and second rack members 141 and 142 with the geared portions of each facing each other and engaging with the pinion 134. The first and second rack members also interlock with the first and second pick-up rollers 131 and 132, which have a spring 133 disposed therebetween to elastically-bias the pick-up rollers 131 and 132 away from each other.

Also, an interlocking piece 132*a* is formed on the second rack member 142. The interlocking piece 132*a* interlocks with the first guide member 210 when the cassette 200 is inserted into the body. Reference numeral 221 denotes a groove formed on the second guide member 220 to prevent the interlocking piece 132*a* from being caught by the second guide member 220, when the cassette 200 is coupled with or separated from the body in the direction indicated by arrow 'E', as shown in FIGS. 3 and 4.

Figure 4:
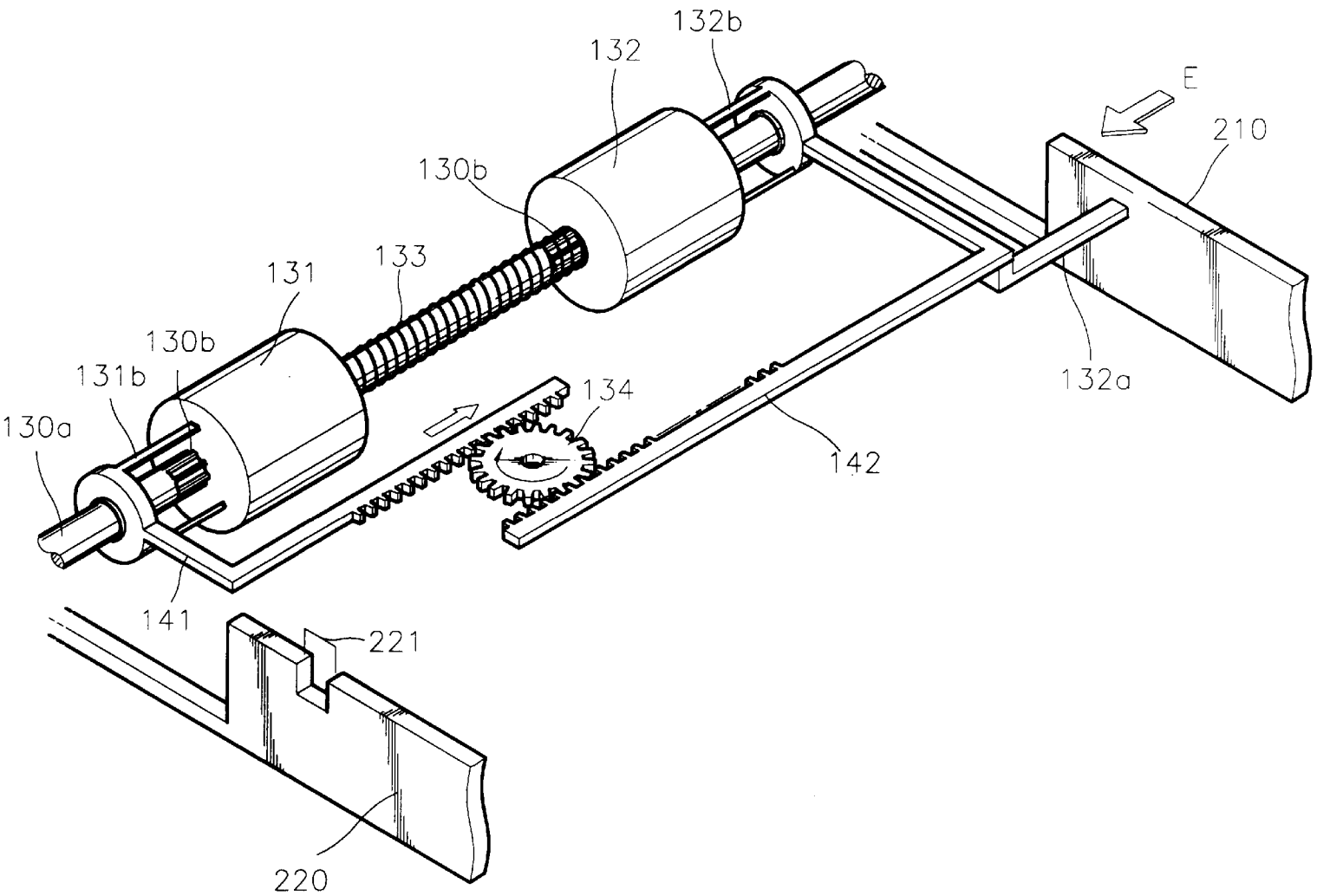
FIG. 4 is a perspective view partially showing the paper feeding apparatus of FIG. 3.

FIG. 4 shows the configuration of the moving means. The first and second pick-up rollers 131 and 132 are coupled with a spline 130*b* formed on the shaft 130*a*, so as to be capable of moving along the shaft 130*a*. One end of each of the first and second rack members 141 and 142 is slidingly coupled with the shaft 130*a*, and includes contact pins 131*b* and 132*b* contacting the sides of the first and second pick-up rollers 131 and 132. Thus, when a pinion 134 rotates clockwise, thereby moving the first and second rack members 141 and 142 in the direction indicated by the arrow in FIG. 4, the contact pins 131*b* and 132*b* press the sides of the first and second pick-up rollers 131 and 132 and the first and second pick-up rollers 131 and 132 move along the shaft 130*a* towards each other. When the pinion 134 rotates counterclockwise, thus moving the first and second rack members 141 and 142 in an opposite direction, the first and second pick-up rollers 131 and 132 come back to an initial position by an elastic force of the spring 133.

Referring to FIGS. 3 and 4, when the different-sized paper is to be received in the cassette 200, the cassette 200 is detached from the body, and then the guide members 210 and 220 are adjusted to the new paper size. In a state in which the cassette 200 is detached from the body, an external force is not applied to the first and second pick-up rollers 131 and 132, which therefore separate to the maximum distance therebetween by action of the spring 133.

When the cassette 200 having the different-sized paper is inserted into the body in the direction indicated by arrow 'E' in FIG. 3, the first guide member 210 contacts the interlocking piece 132*a* and the second rack member 142 moves in the direction indicated by arrow 'F'. Thus, while the pinion 134 rotates, the second rack member 142 interlocking with the pinion 134 moves reversely to the first rack member 141. Also, the first and second pick-up rollers 131 and 132 interlocking with the first and second rack members 141 and 142 move towards each other. Thus, the distance 'D1' between the first and the second guide members 210 and 220 and the first and the second pick-up rollers 131 and 132, respectively, can be maintained at a constant value.

According to the present invention, a distance for forming the curled portion at an end portion of a paper is not changed even though the paper size is changed, so that paper supply can be smoothly performed regardless of the paper size. It is contemplated that numerous modifications may be made to the present invention without departing from the spirit and scope of the invention as defined in the following claims.

What is claimed is:

1. A paper feeding apparatus of a printing device comprising:

a cassette for receiving paper, detachably coupled with a body of the printing device;

guide members, slidingly installed in the cassette, for supporting side portions of the paper;

a pair of pick-up rollers for drawing the paper out from the cassette, said pair of pick-up rollers being positioned for tight contact with the top of the received papers, and being movably installed on a rotating shaft so as to be capable of moving along the shaft; and moving means, interlocking with one of the guide members, for moving the pair of pick-up rollers along the shaft.

2. The paper feeding apparatus of claim 1, wherein the moving means comprises:

a pinion rotatably installed in the body of the printing device; and a pair of rack members having geared portions which engage with the pinion such that the geared portions thereof face each other, and move in opposite directions to each other by interlocking with at least one of the guide members, thereby moving the pick-up rollers towards each other.

3. The paper feeding apparatus of claim 2, wherein each of the pair of rack members has a contact pin contacting a side surface of a respective pick-up roller.

4. The paper feeding apparatus of claim 3, further comprising a spring, installed between the pick-up rollers, for elastically-biasing the pair of pick-up rollers away from each other.

5. The paper feeding apparatus of claim 2, wherein at least one of the rack members is provided with an interlocking piece interlocking with one of the guide members when the cassette is inserted to the body of the printing device.

6. A paper feeding apparatus of a printing device comprising:

a cassette for receiving paper, detachably coupled with a body of the printing device;

guide members, slidingly installed in the cassette, for supporting side portions of the paper;

a pair of pick-up rollers for drawing the paper out from the cassette, said pair of pick-up rollers being positioned for tight contact with the top of the received papers, and being movably installed on a rotating shaft so as to be capable of moving axially along the shaft; and a set of contact pins engaging a side of each pick-up rollers.

7. The paper feeding apparatus of claim 6, further comprising a rack member connected to each set of contact pins, wherein one rack member includes an interlocking piece.

8. The paper feeding apparatus of claim 7, further comprising a pinion gear engaged with both of said rack members.

* * * * *